US005996133A

United States Patent [19]

Fletcher

[11] Patent Number: 5,996,133

[45] Date of Patent: Dec. 7, 1999

[54] TOILET AIDS FOR PARTIALLY DISABLED AND HANDICAPPED PERSONS

[75] Inventor: Richard Edmond Fletcher, Leominster, United Kingdom

[73] Assignee: Mangar International Limited, United Kingdom

[21] Appl. No.: 09/116,275

[22] Filed: Jul. 16, 1998

[30] Foreign Application Priority Data

Aug. 29, 1997 [GB] United Kingdom ..... 9718163

[51] Int. Cl.[6] ..... A47K 13/00

[52] U.S. Cl. ..... 4/239; 4/237

[58] Field of Search ..... 4/239, 238, 237, 4/245.1, 245.2, 243.1, 243.2, 235, 256, 246.1, 246.2

[56] References Cited

U.S. PATENT DOCUMENTS 2,671,226 3/1954 Lycheneheim ..... 4/239

3,153,248 10/1964 Miller ..... 4/239

3,479,087 11/1969 Burke ..... 297/339

5,619,757 4/1997 Baratta ..... 4/239

*Primary Examiner*—Henry J. Recla

*Assistant Examiner*—Huyen Le

*Attorney, Agent, or Firm*—Neil F. Markva

[57] ABSTRACT

A toilet aid (10), for use on an ordinary water closet/toilet fitted with an ordinary lift up toilet seat, which aid comprises an overseat (20) supported on an annular or part annular pneumatically inflatable bag assembly (21), and is characterized in that flexible locating means (22) is attached to a bottom part of the bag assembly (21) so as to be foldable or bendable to extend beneath the toilet seat (14) to locate the bag assembly (21) on the toilet seat (14) for pneumatically raising and lowering the overseat (20) relative thereto.

8 Claims, 3 Drawing Sheets

TOILET AIDS FOR PARTIALLY DISABLED AND HANDICAPPED PERSONS

FIELD OF THE INVENTION

This invention concerns toilet aids for assisting persons with a disability to use a sit-down water closet, and in particular to rise to an upright position, i.e. to stand up again, after using the toilet.

BACKGROUND OF THE INVENTION

There are a multiplicity of such aids already known, which vary greatly in complexity and effectiveness. For example, one known aid comprises a thick plastic overseat having adjustable brackets on its underside to engage and locate the overseat on an ordinary seat of a water closet. This aid is passive and merely enables a user to sit down at a higher than standard height, so that less effort is required to stand up again. It has also been proposed to mount a toilet set on a hydraulically or electrically powered mechanism which can raise and lower the seat (and a person thereon) between a low seating position for using the toilet and a raised position in which the person can straighten his or her legs and move his or her body forwards to achieve a standing position. However, all the aids known at the present time appear to give rise to problems for such persons, including problems of initialing the aid, lack of sufficient assistance afforded by most of the aids, and with those aids which offer lifting assistance, problems of cost, mechanical complexity and physical bulk.

SUMMARY OF THE INVENTION

In order to reduce, avoid or solve these problems, the present invention provides a toilet aid, for use on an ordinary water closet/toilet fitted with an ordinary lift up toilet seat, which aid comprises an overseat supported on an annular or part annular pneumatically inflatable bag assembly, and is characterized in that flexible locating means is attached to a bottom part of the bag assembly so as to be foldable or bendable to extend beneath the toilet seat to locate the bag assembly on the toilet seat for pneumatically raising and lowering the overseat relative thereto.

The aid of the present invention is simple to manufacture and install on a toilet, is easily removed from the toilet for cleaning, is of relatively low weight and cost so as to be more easily afforded by disabled persons, and is very simple and reliable to operate.

The locating means is preferably a flexible skirt which has an opening to accept or align with a usual hinge mounting which supports and pivotally locates the toilet seat.

The bag assembly preferably comprises a small plurality of superimposed bags, e.g. two to four, and preferably three bags, which are pneumatically interconnected.

The overseat is preferably shaped in plan to conform generally to the shape of an ordinary toilet seat, and preferably has an internal dependent flange to shield the internal periphery of the bag assembly from contamination e.g. splashes in use.

The invention also includes a method of making the aid wherein four sheets defining the middle bag, the upper part of the lower bag and the lower part of the upper bag are located in a welding tool on pegs which project through holes in said sheets. A weld blocking interlayer (not shown) is interposed between the sheets forming the middle bag prior to the sheets being welded together to form main seams connecting the middle bag to the aforesaid sheets of the other bags. Thereafter, the part formed bag assembly is sandwiched between a bottom sheet and a top sheet, and the sheets are further welded together to form outer peripheral seams and inner peripheral seams. The bottom sheet has the locating means and an air inlet attached thereto prior to the peripheral seams being formed.

BRIEF DESCRIPTION OF THE DRAWINGS

Other objects of this invention will appear in the following description and appended claims, reference being made to the accompanying drawings forming a part of the specification wherein like reference characters designate corresponding parts in the several views.

DETAILED DESCRIPTION

Figure 1:
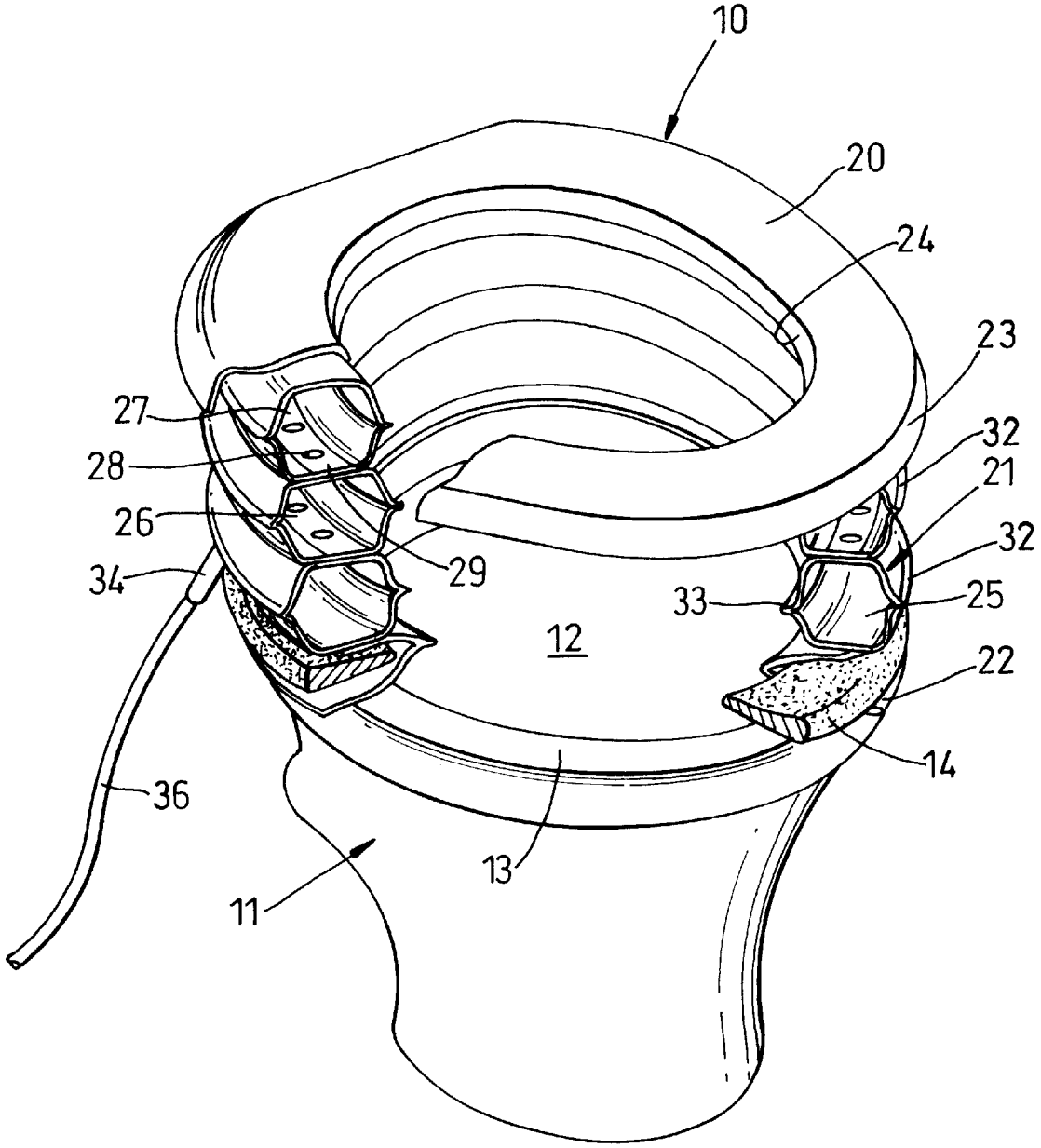
FIG. 1 is a partially cut-away perspective view of a toilet aid of the invention in a fully raised condition and installed on an ordinary toilet.

The toilet aid 10 is configured to suit an ordinary water closet toilet 11 having a bowl 12 which terminates upwardly at a brim 13 on which a toilet seat 14 rests. At the rear of the seat 14, the seat is connected by a hinge mounting (not shown) to the rear of the bowl in known manner.

The aid 10 comprises an overseat 20, a bag assembly 21, and flexible locating means 22. The overseat 20 is a thin walled plastic moulding of inverted shallow channel cross-section having an outer peripheral flange 23 and a deeper dependent inner peripheral flange 24. The inverted channel is dimensioned to accommodate the bag assembly 21 when the latter is deflated.

The bag assembly 21 comprises a stack of three bags namely a lower bag 25, a middle bag 26 and an upper bag 27, each of which is made of two pre-cut to shape sheets of flexible, impervious and substantially inelastic material, e.g. plastics coated cloth. During manufacture the four sheets defining the middle bag 26, the upper part of the lower bag 25 and the lower part of the upper bag 27 are located in a welding tool on pegs 31 which project through holes 28 in said sheets and a weld blocking interlayer (not shown) is interposed between the sheets forming the middle bag 26 prior to the sheets being welded together to form main seams 29 connecting the middle bag to the aforesaid sheets of the other bags. Thereafter, the part formed bag assembly is sandwiched between a bottom sheet and a top sheet, and the sheets are further welded together to form outer peripheral seams 32 and inner peripheral seams 33. The bottom sheet has the member 22 and an air inlet 34 attached thereto prior to the peripheral seams 32, 33 being formed. The aligned holes 28 serve as inter bag ducts during inflation and deflation of the assembly 21.

Figure 2:
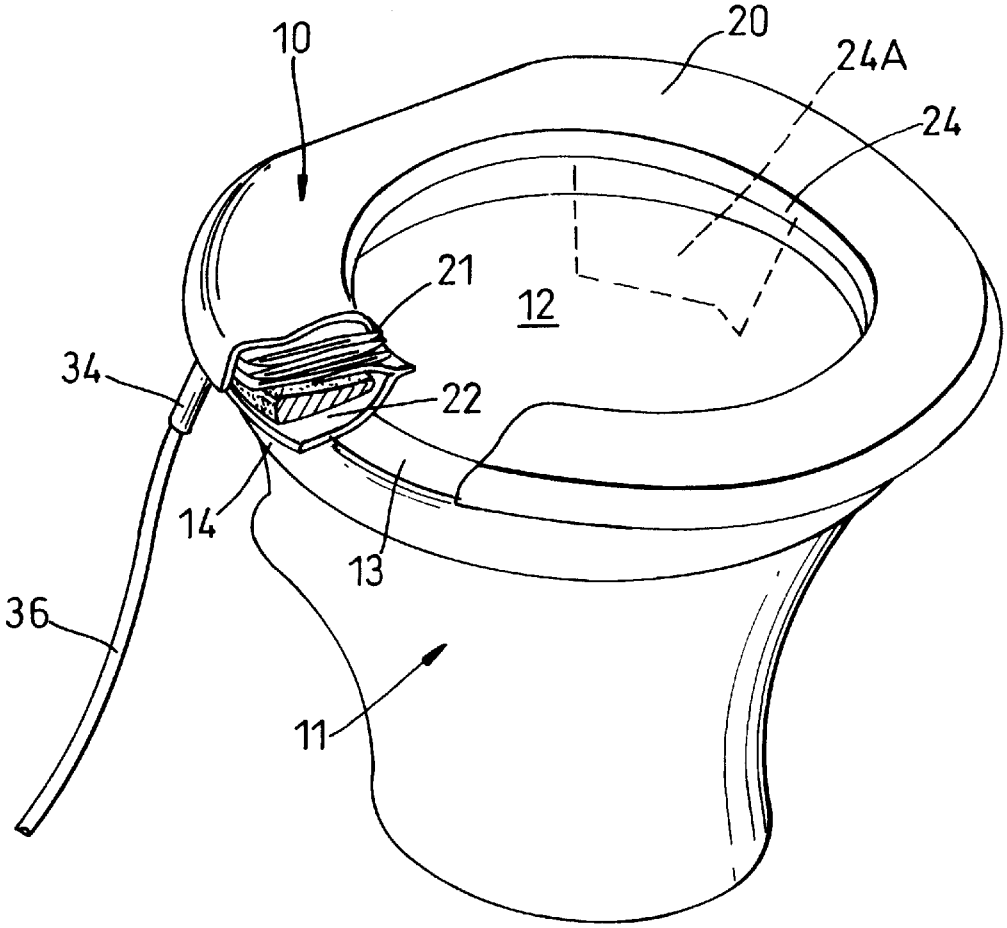
FIG. 2 is a view similar to FIG. 1 showing the aid in a lowered condition.
Figure 3:
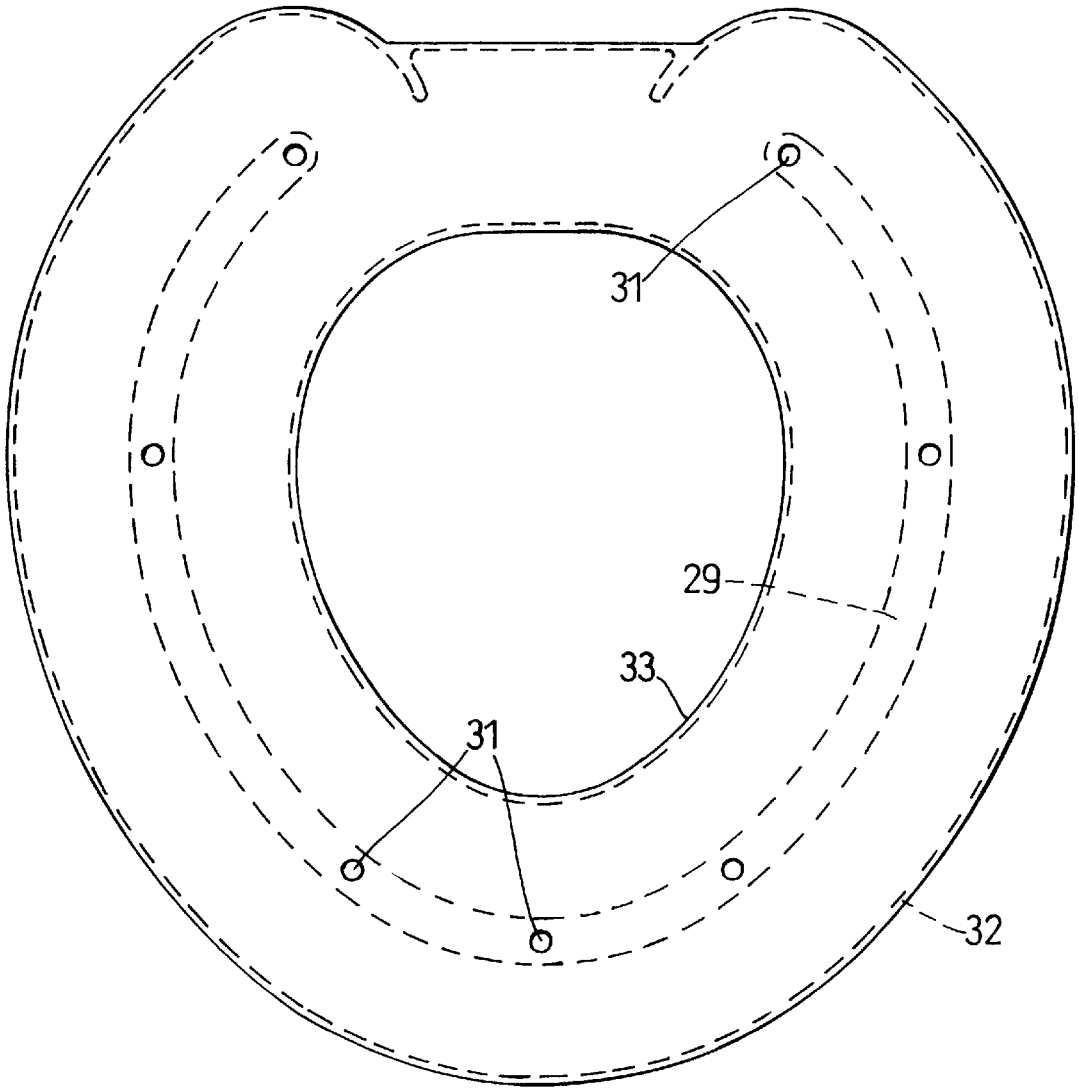
FIG. 3 is a plan view of a partially completed bag assembly, showing weld areas, for use in the toilet aid.

The overseat 20 is then secured, e.g. bonded or glued, on the upper bag 27 so that the deflated bag assembly 21 fits into the inverted channel between the flanges 23 and 24. An optional flexible internal skirt 24A may be attached, preferably releasably, to the flange 24, to hang down inside the aid (as indicated in broken lines in FIG. 2), to shield the bag assembly 21 from splashes.

The locating means 22 is made of said flexible material or a material mechanically similar thereto so as to take the form of a sub-skirt which is folded back to extend outwardly below the seat 14 so that it becomes trapped and held between the seat 14 (or feet thereon) and the brim 13, to hold the aid 10 on the seat 14. Location of the aid 10 on the seat 14 is enhanced by the lower bag 25 becoming stiff when inflated to support the shape of the member 22.

Inflation and deflation of the assembly 21 for raising and lowering the overseat 20 is controlled by controlled pressurization and depressurisation of a pneumatic line 36 connected to the inlet.

The invention is not confined to details of the foregoing example, and many variations are possible within the scope of the invention. For example the locating means may be in the form of tethers or straps which can be extended under the toilet seat and secured in position, e.g. secured to the outside periphery of the lower bag or secured to an end portion of the or another strap attached to the lower bag. Alternatively flexible or other fastening means may be provided on the locating means so that said means can be fastened around the toilet seat.

Rear portions of the aid may be shaped to accommodate, or at least not to foul, the hinge mounting.

Means, e.g. drop threads or transverse webs, may be provided in each bag to limit the inflated height of each bag, and the bags may be adapted and arranged for sequential inflation and/or deflation, e.g. each bag may have a respective inlet 34 for attachment of a respective pneumatic line 36.

The invention further includes and provides an aid having any novel feature of form or function disclosed herein and any novel combination or mechanical or functional equivalent thereof. The terms and expressions used herein are by way of example and shall be deemed to embrace and disclose synonymous generic and equivalent terms and expressions.

I claim:

1. A toilet aid for use on an ordinary water closet/toilet fitted with an ordinary lift up toilet seat, which aid comprises:

a) an overseat supported on an annular or part annular pneumatically inflatable bag assembly, and b) flexible locating means is attached to a bottom part of the bag assembly to extend beneath the toilet seat to locate the bag assembly on the toilet seat for pneumatically raising and lowering the overseat relative thereto.

2. A toilet aid as claimed in claim 1 wherein the locating means is a flexible skirt which has an opening to accept or align with a usual hinge mounting which supports and pivotally locates the toilet seat.

3. A toilet aid as claimed in claim 1 wherein the locating means is in the form of tethers or straps which can be extended under the toilet seat and secured in position.

4. A toilet aid as claimed in claim 1, 2 or 3 wherein the bag assembly comprises a small plurality of superimposed bags.

5. A toilet aid as claimed in claim 4 wherein the bag assembly comprises three bags which are pneumatically interconnected.

6. A toilet aid as claimed in claim 4 wherein the overseat is shaped in plan to conform generally to the shape of an ordinary toilet seat.

7. A toilet aid as claimed in claim 1 wherein the overseat includes a dependent internal flange with means to hang said flange therefrom to shield the internal periphery of the bag assembly from contamination in use.

8. A toilet aid as claimed in claim 1 wherein said bag assembly includes a middle bag, an upper part of a lower bag, and a lower part of an upper bag defined by four sheets which have been welded together to form main seams connecting the middle bag to said sheets that form said middle bag, said upper part of the lower bag, and said lower part of said upper bag to produce a partial bag assembly;

said partial bag assembly being sandwiched between a bottom sheet and a top sheet, and said sheets that form each said upper, middle, and lower bags being respectively further welded together to form outer peripheral seams and inner peripheral seams; and the flexible locating means and an air inlet are attached to said bottom sheet.

* * * * *